United States Patent [19]

Schibisch

[11] Patent Number: 4,577,722

[45] Date of Patent: Mar. 25, 1986

[54] COMMERCIAL VEHICLE, ESPECIALLY FORKLIFTER

[75] Inventor: Horst Schibisch, Leonberg, Fed. Rep. of Germany

[73] Assignee: Dr. Ing. h.c.F. Porsche AG, Fed. Rep. of Germany

[21] Appl. No.: 543,419

[22] Filed: Oct. 19, 1983

[30] Foreign Application Priority Data

Oct. 19, 1982 [DE] Fed. Rep. of Germany ..... 3238597

[51] Int. Cl.[4] ..... G05G 1/14

[52] U.S. Cl. ..... 180/315; 296/190; 296/204

[58] Field of Search ..... 296/190, 194, 204, 208, 296/37.14; 180/315, 329, 327, 335, 336, 89.12

[56] References Cited

U.S. PATENT DOCUMENTS

| | | | |
|---|---|---|---|
| 2,014,854 | 9/1935 | Lathrop | 180/335 |
| 2,129,851 | 9/1938 | Lee | 180/315 |
| 4,050,733 | 9/1977 | Borrill | 296/204 |
| 4,312,418 | 1/1982 | Rittman | 296/190 |

FOREIGN PATENT DOCUMENTS

| | | |
|---|---|---|
| 38499 | 6/1965 | Fed. Rep. of Germany . |
| 1405194 | 10/1968 | Fed. Rep. of Germany . |
| 2831753 | 2/1979 | Fed. Rep. of Germany . |

*Primary Examiner*—Robert R. Song

*Attorney, Agent, or Firm*—Craig & Burns

[57] ABSTRACT

In a forklifter with an operator's platform supported at the vehicle frame, the platform is formed by a floor plate underneath which are provided mounting supports for the actuating devices which are accessible from the operator's platform and are connected with the installations to be actuated by way of connecting lines; the actuating devices are supported in a tub-shaped housing open in the direction toward the floor plate which, together with the actuating devices and the connections thereof, forms a preassembled unit which is inserted between cross bearers of the superstructure and is retained thereat in a detachable manner.

23 Claims, 5 Drawing Figures

COMMERCIAL VEHICLE, ESPECIALLY FORKLIFTER

The present invention relates to a commercial vehicle, especially a forklifter or the like with an operator's platform supported at the vehicle frame that includes mounting supports for actuating devices arranged below a floor plate.

It is known in connection with forklifters to provide mounting supports for actuating devices underneath a floor plate delimiting the operator's platform in the downward direction. These actuating devices are foot pedals which are extended through the floor plate and are accessible from the operator's platform. The pedals are connected by way of connecting lines to the mechanisms to be actuated thereby, such as the engine, transmission, brake or the like. The mounting support of the pedals takes place at the body under interconnection of brackets or the like. These brackets are fixedly installed in the vehicle. This fixed arrangement of the pedals in the vehicle is disadvantageous since it is simpler from the assembly point of view to create a separate structural unit consisting of pedals supported by a mounting support, which is installed into the vehicle fully assembled and whose connecting lines are connected centrally by way of connections with the connecting lines for the mechanisms to be actuated. The fixed arrangement of the pedal structure in the vehicle is also disadvantageous in connection with service and repair operations since the accessibility in the vehicle between other aggregates is less favorable than with a pedal unit detached out of the vehicle.

It is the object of the present invention to eliminate the aforementioned shortcomings of the prior art forklifters as regards the operating unit, especially as regards the pedal structure and to create with lowest structural expenditures an operator's platform having the operating unit including the pedals which can be easily installed and is readily accessible for servicing and repair work.

The underlying problems are solved according to the present invention in that the actuating devices are supported in a tub-shaped housing open in the direction toward the floor plate, which housing, together with the actuating devices and the connections thereof, forms a preassembled unit that is detachably retained at fixed vehicle frame parts of the superstructure.

The advantages principally achieved with the present invention consist in the simple assembly of the pedal-operating unit into the vehicle. Furthermore, they reside in the good accessibility as well as the protected arrangement of the pedal structure by an encapsulation in a housing. Soiling and hard-to-operate pedals conditioned thereby are precluded. For repair and possibly also service purposes of the pedal structure, it is possible in a simple manner by disengagement of the few fastening bolts or other retaining elements to lift the pedal-operating unit out of the vehicle. The connecting lines to the pedals are to be separated or to be connected either by way of rapidly detachable connections at the housing or at another readily accessible location.

These and other objects, features and advantages of the present invention will become more apparent from the following description when taken in connection with the accompanying drawing which shows, for purposes of illustration only, one embodiment in accordance with the present invention, and wherein.

Figure 1:
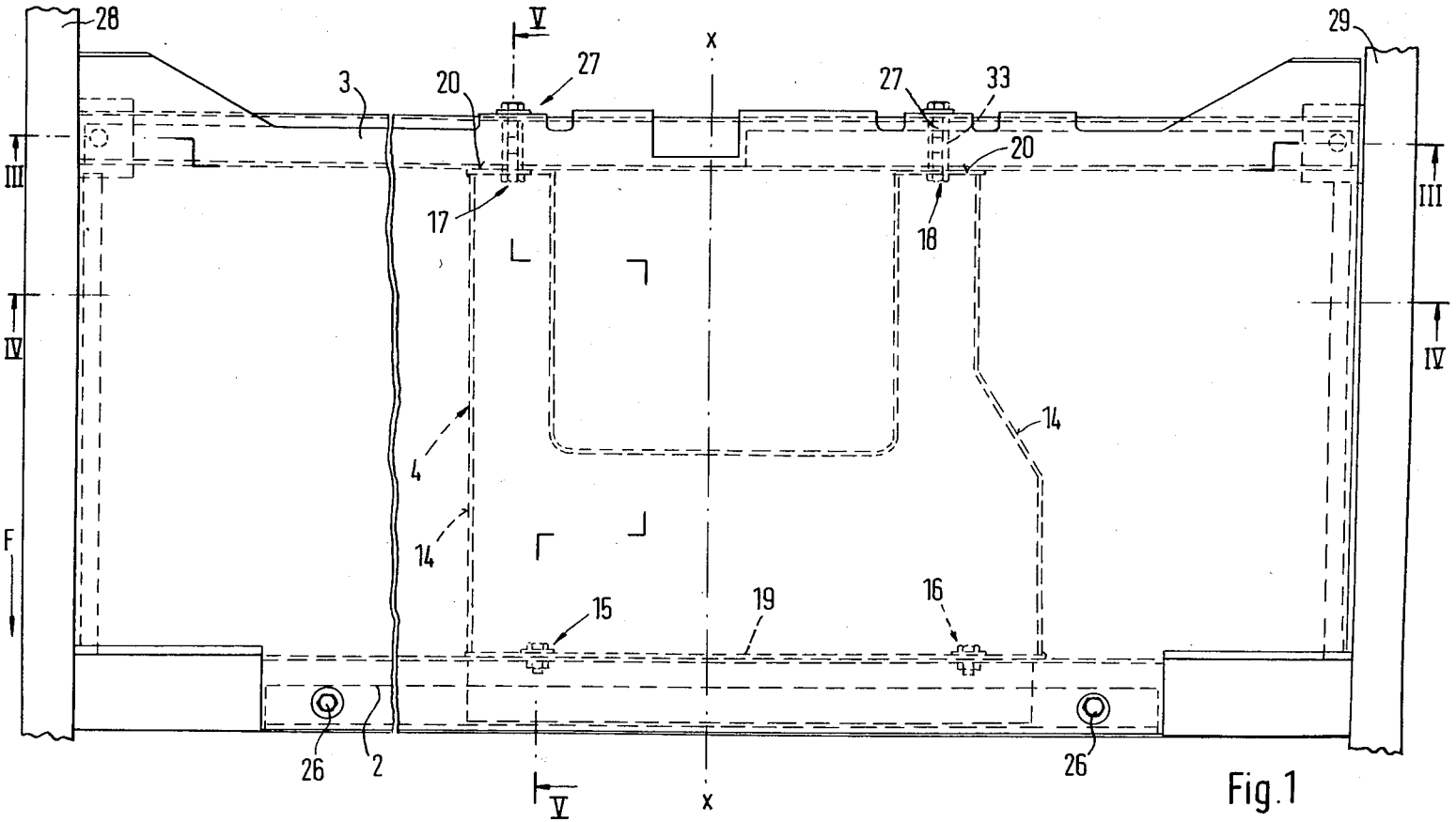
FIG. 1 is a plan view on a platform of an operator's platform with a housing for the accommodation of the pedal structure in accordance with the present invention.
Figure 2:
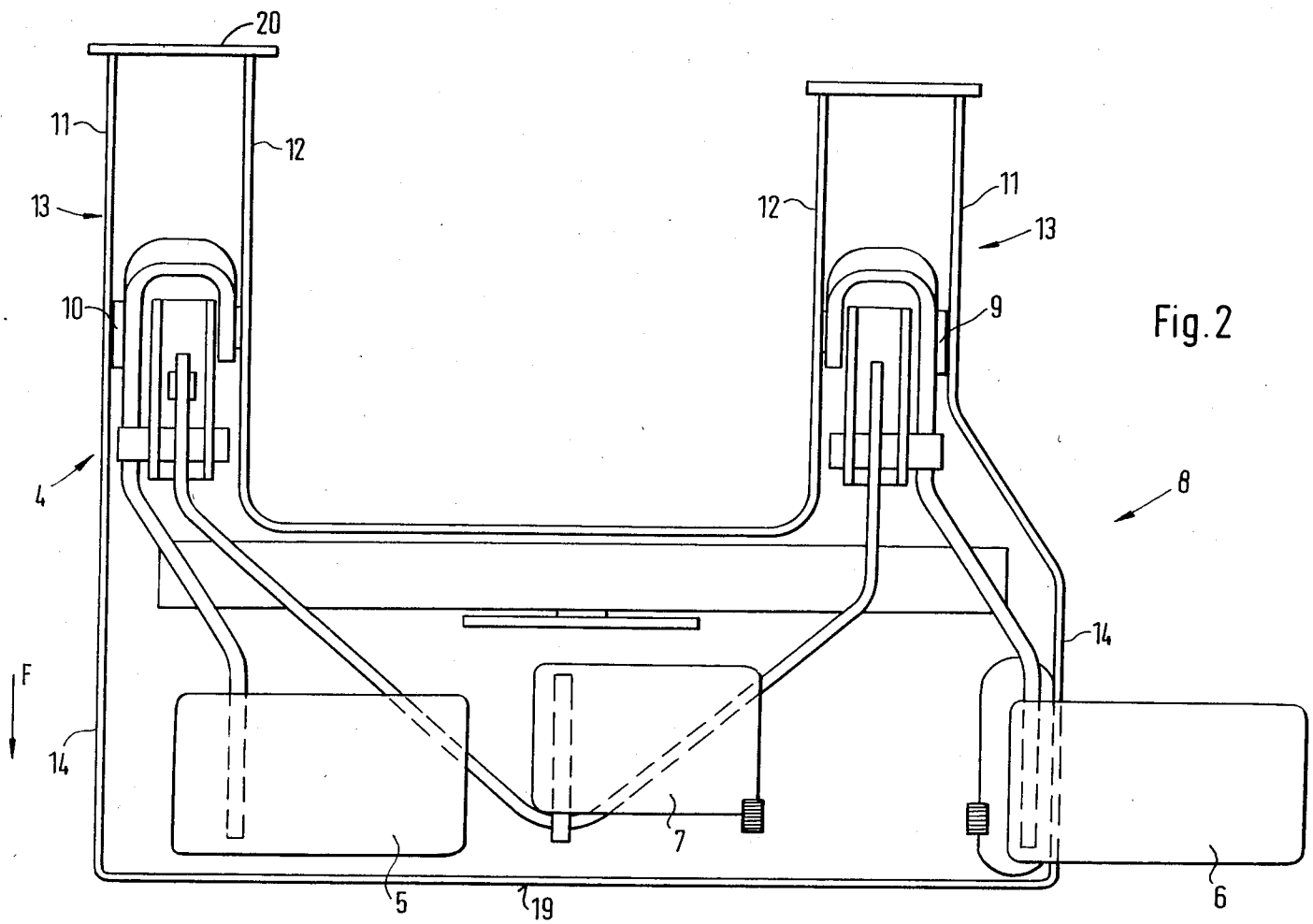
FIG. 2 is a plan view, on an enlarged scale, of the housing with the pedal mounting supports in accordance with the present invention.
Figure 3:
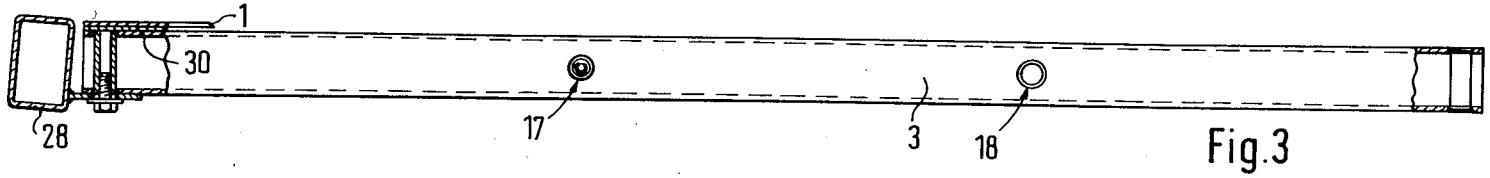
FIG. 3 is a cross-sectional view, taken along line III—III of FIG. 1 through a forward cross bearer—as viewed in the driving direction.
Figure 5:
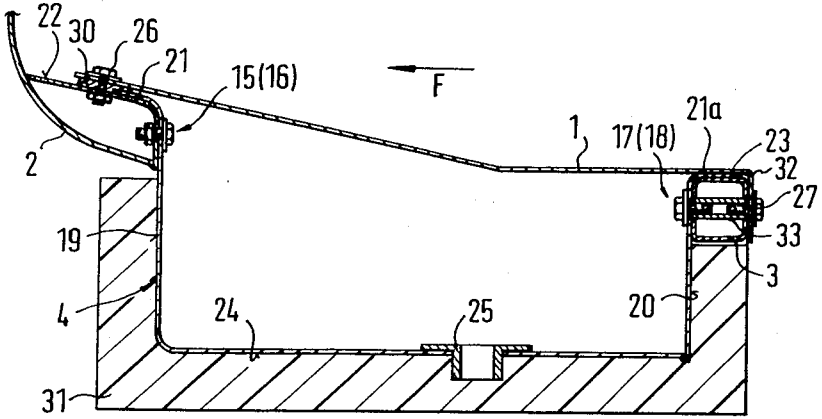
FIG. 5 is a cross-sectional view taken along line V—V of FIG. 1.

Referring now to the drawing wherein like reference numerals are used throughout the various views to designate like parts, an operator's platform is provided in a forklifter which includes a driver seat with a steering wheel as well as further actuating devices such as levers, pedals, etc. The pedals for the operator are arranged in the leg space which includes a platform formed by a floor plate 1 (FIG. 5). The floor plate 1 is retained at cross bearers 2 and 3 as well as at longitudinal bearers 28 and 29 of the superstructure of the vehicle. A tub-shaped housing generally designated by reference numeral 4 is mounted underneath the floor plate 1 approximately in the longitudinal center plane X-S of the vehicle between the forward cross bearer 2 and the rear cross bearer 3, which is open in the direction toward the floor plate 1 and in which are supported the actuating devices such as the drive pedals 5 and 6 as well as a brake pedal 7. The housing 4 forms together with the pedals 5, 6, and 7 a preassembled unit which is generally designated by reference numeral 8 (FIG. 2).

The bearing and mounting supports 9 and 10 for the pedals 5, 6, and 7 are, for example, supported in the illustrated embodiment at the walls 11 and 12 of the housing extensions 13. In another embodiment of the housing 4, the bearing and mounting supports 9 and 10 are formed by the outer walls 14 as well as by correspondingly supportingly effective brackets, support lugs, or the like.

The fixing of the housing 4 in the superstructure between the cross bearers 2 and 3 takes place by way of the fastening bolts 15 and 16 between the forward boundary wall 19 and the cross bearer 2 and by way of the fastening bolts 17 and 18 between the rear boundary wall 20 and the corresponding cross bearer 3.

In a preferred embodiment of the housing 4, the edges 21 and **21*a* which face the cross bearers 2 and 3, are angularly bent off outwardly in such a manner that they rest on the top side 22 of the cross bearer 2 as well as on the top side 23 of the cross bearer 3 and retain the housing 4 in a position appropriate for fastening. For the connection of lines such as Bowden cables, cables, hoses and the like, which extend from the engine transmission as well as from the brakes to the pedals 5, 6 and 7, readily accessible separable connections may be provided in the floor 24, respectively, at the side walls 14 of the housing 4 which are not illustrated in detail herein since they may be of any conventional construction. However, it is also feasible within the scope of the present invention to extend the lines through corresponding sealing bushes 25 of the housing 4** and to provide the connections for the separation and connection of the lines at another readily accessible location.

The covering of the housing 4 takes place by way of the floor plate 1. It extends in one piece over the entire platform of the operator's stand and is retained at the cross bearers 2 and 3 by way of fastening bolts 26 and 27. A further support of the plate 1 takes place at the longitduinal bearers 28 and 29. According to another embodiment of the present invention, the floor plate 1 may also be constructed multi-partite. In this case, a part of the floor plate corresponding to the size of the housing 4 is constructed in such a manner that the unit 8 can be inserted and removed without impairment. This part of the floor plate can also be constructed to be pivotal.

Figure 4:
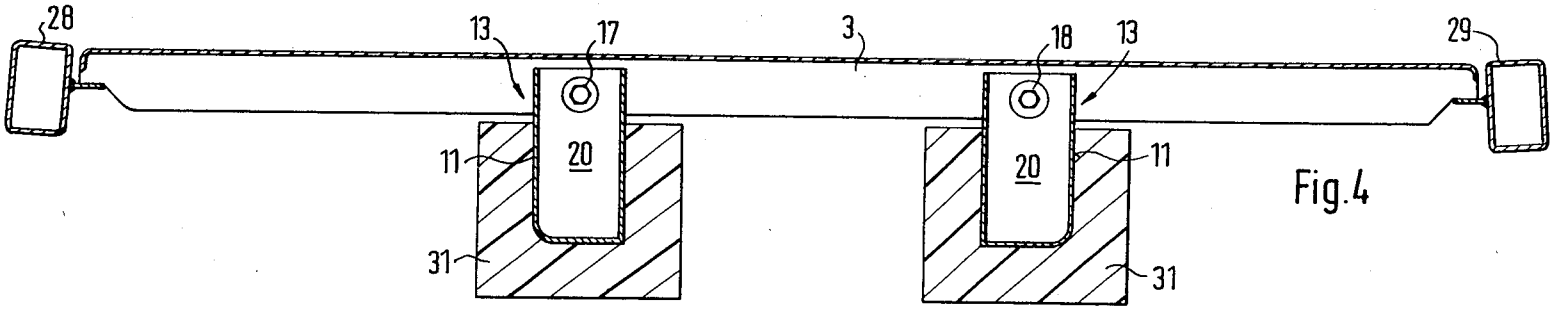
FIG. 4 is a cross-sectional view, taken along line IV—IV of FIG. 1.

For purposes of avoiding a transmission of vibrations, an elastic means 30 (FIG. 5) is provided between the floor plate 1 and the bearers 2, 3 and 28, 29. Also, an elastic layer is interposed between the two vertical walls 14 of the container 4 and the oppositely disposed vertical sections of the bearers 2 and 3, which, however, is not illustrated for the sake of simplicity. For soundproofing, the entire housing 4 is coated with a corresponding material 31 (FIGS. 4 and 5).

As shown more fully in FIG. 5, the floor plate 1 is provided at its rear free end with an angularly bent portion 32 which extends over the cross bearer 3 and engages the rear side thereof. The fastening bolts 26 and 27 are provided in the angularly bent portion 32 which connect the floor plate 1 with the bearer 3. These fastening bolts 26 and 27 are retained at each side in a threaded bush 33 welded into the bearer 3, which at the same time receives the fastening bolts 17 and 18 for fixing the container 4.

While I have shown and described only one embodiment in accordance with the present invention, it is understood that the same is not limited thereto but is susceptible of numerous changes and modifications as known to those skilled in the art, and I therefore do not wish to be limited to the details shown and described herein but intend to cover all such changes and modifications as are encompassed by the scope of the appended claims.

I claim:

1. A forklift assembly with an operator's platform mounted on the vehicle frame, said platform having mounting supports for actuating elements disposed beneath a floor plate, said elements being accessible from the operator's platform and connected by connecting lines with the devices to be actuated, the assembly comprising a on-piece tub-shaped housing mounted interchangeably by releasable fastening means between cross members in the bottom of the body structure of the vehicle, said tub-shaped housing being open toward the floor plate, and wherein the tub-shaped housing constitutes a pre-assembled module with operating elements and their connections and the bearing and the mounting supports of actuating elements are disposed within the tub-shaped housing in sealed off capsule-fashion from the interior of the vehicle by a floor plate which is held by fastening elements.

2. A forklift according to claim 1, wherein the tub-shaped housing receives, on its outside walls extending lengthwise of the vehicle, and also on internal supports, said bearing and mounting supports for the actuating elements inside the tub-shaped housing.

3. A commercial vehicle comprising vehicle frame means, operator's platform means supported at the vehicle frame means, the operators platform including mounting support means for actuating devices underneath a floor plate means which are accessible from the operator's platform means and are connected by way of connecting lines with installations to be actuated, wherein the actuating devices are supported in a tub-shaped housing means open in the direction toward the floor plate means, said housing means together with the actuating devices and the connections thereof forming a preassembled unit which is detachably retained at fixed frame parts of the frame means, wherein the housing means receives the mounting support means for the actuating devices at its outer walls extending generally in the longitudinal direction of the vehicle as well as at inner supports thereof, and the housing means is arranged between two cross bearer means of the frame means and in that a forwardly disposed boundary wall of the housing means, as viewed in the driving direction, is fastened to one of the cross bearer means by way of fastening bolts and a rearwardly disposed boundary wall thereof is connected with the other bearer means by way of fastening bolts.

4. A commercial vehicle according to claim 3, characterized in that the length of the housing means corresponds essentially to the distance between the two cross bearer means.

5. A commercial vehicle according to claim 4, characterized in that the edges of the housing means facing the cross bearer means are angularly bent-off outwardly and rest on the top side of the bearer means and retain the housing means in position.

6. A commercial vehicle according to claim 5, characterized in that an elastic layer is provided in the contact area between the forwardly disposed vertical wall and the rearwardly disposed wall of the housing means and the corresponding surfaces of the bearer means.

7. A commercial vehicle according to claim 5, characterized in that the floor plate means is in one-piece and extends over the entire platform means of the operator's stand and is connected by way of fastening bolts with the cross bearer means.

8. A commercial vehicle according to claim 5, characterized in that the floor plate means is constructed multi-partite and a part of the floor plate means corresponding to the size of the housing means is so constructed that the preassembled unit can be inserted and removed unimpededly.

9. A commercial vehicle according to claim 6, characterized in that the floor plate means is operatively connected with the cross bearer means under interposition of elastic means.

10. A commercial vehicle according to claim 9, characterized in that for purposes of connecting lines such as Bowden cables, cables, hoses, and the like which extend from the engine and transmission as well as from brakes and possibly other attachment aggregates to the actuating devices, separable connecting means are provided in the bottom, respectively, side walls of the housing means.

11. A commercial vehicle according to claim 10, characterized in that the housing means is coated with a sound-absorbing material at least at one of its outer and inner wall surfaces.

12. A commercial vehicle according to claim 11, characterized in that the housing means is coated with the sound-absorbing material at both its outer and inner wall surfaces.

13. A commercial vehicle according to claim 11, characterized in that the floor plate means is angularly bent within the area of its fastening at the cross bearer means and thereby surrounds the same and the connection with the bearer means takes place under interposition of a welded-in threaded bush means which retains the fastening bolts and at the same time serves for receiving the further fastening bolts for the housing means.

14. A commercial vehicle comprising vehicle frame means, operator's platform means supported at the vehicle frame means, the operator's platform including mounting support means for actuating devices underneath a floor plate means which are accessible from the operator's platform means and are connected by way of connecting lines with installations to be actuated, wherein the actuating devices are supported in a tub-shaped housing means open in the direction toward the floor plate means, said housing means together with the actuating devices and the connections thereof forming a preassembled unit which is detachably retained at fixed frame parts of the frame means, and the housing means is arranged between two cross bearer means of the frame means and in that a forwardly disposed boundary wall of the housing means, as viewed in the driving direction, is fastened to one of the cross bearer means by way of fastening bolts and a rearwardly disposed boundary wall thereof is connected with the other bearer means by way of fastening bolts.

15. A commercial vehicle according to claim 14, characterized in that the length of the housing means corresponds essentially to the distance between fhe two cross bearer means.

16. A commercial vehicle comprising vehicle frame means, operator's platform means supported at the vehicle frame means, the operator's platform including mounting support means for actuating devices underneath a floor plate means which are accessible from the operator's platform means and are connected by way of connecting lines with installations to be actuated, wherein the actuating devices a supported in a tub-shaped housing means open in the direction toward the floor plate means, said housing means together with the actuating devices and the connections thereof forming a preassembled unit which is detachably retained at fixed frame parts of the frame means, and the edges of the housing means facing cross bearer means of the frame means are angularly bent-off outwardly and rest on the top side of the bearer means and retain the housing means in position.

17. A commercial vehicle according to claim 14, characterized in that an elastic layer is provided in the contact area between the forwardly disposed vertical wall and the rearwardly disposed wall of the housing means and the corresponding surfaces of the bearer means.

18. A commercial vehicle comprising vehicle frame means, operator's platform means supported at the vehicle frame means, the operator's platform including mounting support means for actuating devices underneath a floor plate means which are accessible from the operator's platform means and are connected by way of connecting lines with installations to be actuated, wherein the actuating devices are supported in a tub-shaped housing means open in the direction toward the floor plate means, said housing means together with the actuating devices and the connections thereof forming a preassembled unit which is detachably retained at fixed frame parts of the frame means, and the floor plate means is in one-piece and extends over the entire platform means of the operator's stand and is connected by way of fastening bolts with the cross bearer means.

19. A commercial vehicle comprising vehicle frame means, operator's platform means supported at the vehicle frame means, the operator's platform including mounting support means for actuating devices underneath a floor plate means which are accessible from the operator's platform means and are connected by way of connecting lines with installations to be actuated, wherein the actuating devices are supported in a tub-shaped housing means open in the direction toward the floor plate means, said housing means together with the actuating devices and the connections thereof forming a preassembled unit which is detachably retained at fixed frame parts of the frame means, and the floor plate means is constructed multi-partite and a part of the floor plate means corresponding to the size of the housing means is so constructed that the preassembled unit can be inserted and removed unimpededly.

20. A commercial vehicle with cross bearer means comprising vehicle frame means, operator's platform means supported at the vehicle frame means, the operator's platform including mounting support means for actuating devices underneath a floor plate means which are accessible from the operator's platform means and are connected by way of connecting lines with installations to be actuated, wherein the actuating devices are supported in a tub-shaped housing means open in the direction toward the floor plate means, said housing means together with the actuating devices and the connections thereof forming a preassembled unit which is detachably retained at fixed parts of the frame means, and the floor plate means is operatively connected with cross bearer means under interposition of elastic means.

21. A commercial vehicle with cross bearer means comprising vehicle frame means, operator's platform means supported at the vehicle frame means, the operator's platform including mounting support means for actuating devices underneath a floor plate means which are accessible from the operator's platform means and are connected by way of connecting lines with installations to be actuated, wherein the actuating devices are supported in a tub-shaped housing means open in the direction toward the floor plate means, said housing means together with the actuating devices and the connections thereof forming a preassembled unit which is detachably retained at fixed frame parts of the frame means, and for purposes of connecting lines such as Bowden cables, cables, hoses, and the like which extend from the engine and transmission as well as from brakes and possibly other attachment aggregates to the actuating devices, separable connecting means are provided in the bottom, respectively, side walls of the housing means.

22. A commercial vehicle with cross bearer means comprising vehicle frame means, operator's platform means supported at the vehicle frame means, the operator's platform including mounting support means for actuating devices underneath a floor plate means which are accessible from the operator's platform means and are connected by way of connecting lines with installations to be actuated, wherein the actuating devices are supported in a tub-shaped housing means open in the direction toward the floor plate means, said housing means together with the actuating devices and the connections thereof forming a preassembled unit which is detachably retained at fixed frame parts of the frame means, and the housing means is coated with a sound-absorbing material at least at one of its outer and inner wall surfaces.

23. A commercial vehicle with bearer means comprising vehicle frame means, operator's platform means supported at the vehicle frame means, the operator's platform including mounting support means for actuating devices underneath a floor plate means which are accessible from the operator's platform means and are connected by way of connecting lines with installations to be actuated, wherein the actuating devices are supported in a tub-shaped housing means open in the direction toward the floor plate means, said housing means together with the actuating devices and the connections thereof forming a preassembled unit which is detachably retained at fixed frame parts of the frame means, and the floor plate means is angularly bent within the area of its fastening at the cross bearer means and thereby surrounds the same and the connection with the bearer means takes place under interposition of a welded-in threaded bush means which retains fastening bolts and at the same time serves for receiving further fastening bolts for the housing means.

* * * * *